United States Patent [19]

Farmer

[11] Patent Number: 4,742,656

[45] Date of Patent: May 10, 1988

[54] EARTH ANCHOR WITH MULTI-SIDED BLADE

[75] Inventor: Marion R. Farmer, Germantown, Tenn.

[73] Assignee: Dixie Electrical Manufacturing Company, Memphis, Tenn.

[21] Appl. No.: 931,917

[22] Filed: Nov. 17, 1986

Related U.S. Application Data

[63] Continuation of Ser. No. 681,665, Dec. 14, 1984, abandoned.

[51] Int. Cl.[4] ..... E02D 5/74

[52] U.S. Cl. ..... 52/155; 52/157; 175/394

[58] Field of Search ..... 52/155, 157, 158, 161; 175/394

[56] References Cited

U.S. PATENT DOCUMENTS

| | | | |
|---|---|---|---|
| 2,567,084 | 9/1951 | Stokes | 175/394 |
| 3,016,117 | 1/1962 | Petersen | 52/157 |
| 3,645,055 | 2/1972 | Roza | 52/157 |
| 3,793,786 | 2/1974 | Jahnke | 52/157 |
| 4,290,245 | 9/1981 | Pardue, Jr. et al. | 52/157 |
| 4,467,575 | 8/1984 | Dziedzic | 52/157 |
| 4,492,493 | 1/1985 | Webb | 52/157 X |

*Primary Examiner*—Carl D. Friedman
*Assistant Examiner*—Creighton Smith
*Attorney, Agent, or Firm*—Paul M. Denk

[57] ABSTRACT

An earth anchor for embedding within the ground and incorporating a helical blade(s), having flattened side edges, intervened by rounded or arcuate corners, and connecting with its shank for securement with any driving apparatus useful for the power driving of such an earth anchor into the ground; while the shaped blade of this anchor incorporates a lineal cutting edge, and an arcuate cutting edge, that integrally blends into a segment of the lineal side edge of the blade, and which composite edges function as a compound cutting edge for driving of the earth anchor into the soil, and through the exertion of only a reduced force.

6 Claims, 1 Drawing Sheet

EARTH ANCHOR WITH MULTI-SIDED BLADE

This is a continuation application of that application having Ser. No. 681,665, filed on Dec. 14, 1984, now abandoned.

BACKGROUND OF THE INVENTION

This invention relates generally to an earth anchor, and more specifically pertains to an earth anchor incorporating a multi-sided blade for facilitating the implanting of the earth anchor into the ground, and to accomplish such through the excertion of reduced force during its embedment.

There are a variety of earth anchors that have been designed for application deep into the soil, and which have application for securement of some other component stationarily to the ground, such as a guy wire, or other structure, that needs to be reasonably affixed to the earth. Such anchors, normally identified as screw anchors, or other types of anchoring means, are preferably powered by a tool for turning into secure confinement within the ground. Many of these anchors have their own particular style of helical blade for accomplishing their sought-for results, and perhaps each of these prior art anchors do attain that result for which they were originally intended to achieve.

One such anchor is shown in the U.S. Pat. No. 4,290,245, identified as an earth anchor, and which is beneficial from the standpoint of including a lagging type of cutting edge, at the lower level of its helical flight, for digging into the earth as the anchor is applied. The advantage of the lagging edge, as defined in this patent, is to provide means for pushing debris laterally of the blade, during its application. It may be commented that the identified earth anchor of this U.S. Pat. No. 4,290,245, is owned by the common assignee of this invention.

Various other forms of earth anchors are shown in the U.S. patent to Williams, upon a screw anchor, disclosed in U.S. Pat. No. 2,234,907. Such an anchor is of a continuous helix type, being generally circular in configuration. Various related types of earth anchors, and the means for connecting their tubular shaft driving tools to them, are shown in the U.S. Pat. No. 1,940,938, in addition to the U.S. Pat. No. 4,334,392, to the inventor Dziedzic. Other forms of ground anchors are shown in the U.S. Pat. No. 888,917, to Lucas, while a further continuous helical form of anchor, in this particular instance, forming a fence post, is shown in the U.S. Pat. No. 505,811, to Brown. Other earth anchors, and their installation tools, are shown in the U.S. Pat. No. 3,148,510, to Sullivan, in addition to the patent to Jahnke, in U.S. Pat. No. 3,832,861.

Various other U.S. patents showing anchors, having helical blades, are disclosed in the patent to Mullett, U.S. Pat. No. 1,791,368, the patent to Gunnison, U.S. Pat. No. 2,380,692, the patent to Neptune, U.S. Pat. No. 2,772,560, the patent to Love, U.S. Pat. No. 3,830,315, in addition to the patent to Abbot, U.S. Pat. No. 3,871,142.

Other United States patents disclosing related styles of earth anchors are shown in the patent to Jahnke, U.S. Pat. No. 3,793,786, in addition to the U.S. patents to Roza, U.S. Pat. Nos. 3,645,055, and 3,662,436, and in addition, the patent to Petres, U.S. Pat. No. 3,828,562, and the patent to Petersen, U.S. Pat. No. 3,016,117. Similar types of anchors are shown in the U.S. patents to Smith U.S. Pat. No. 1,193,725, Bash, U.S. Pat. No. 1,883,477, Dray, U.S. Pat. No. 1,388,031, Maloney, U.S. Pat. No. 1,283,246, and the patent to Widmer, U.S. Pat. No. 816,631.

The advantages of the current invention is to provide a multi-sided blade for an earth anchor, wherein various edges of the sides of the blade are useful for co-operating with the blade's cutting edge for reducing the force requirements, and the moments of force necessary, for embedding the anchor deeply into the ground.

It is, therefore, the principal object of this invention to provide a multi-sided blade for an earth anchor, and which facilitates the penetration of the anchor into the earth.

Another object of this invention is to provide a multi-sided earth anchor, having arcuate corners between adjacent sides and edges, and which reduces the force requirements for embedment of the anchor into the ground.

Still another object of this invention is to provide an earth anchor wherein its moments of force required to penetrate the anchor into the earth are substantially reduced due to its blade's configuration.

Still another object of this invention is to provide means for coupling a driving tool directly upon the anchor shank, freed of direct contact with the shaft mounting its blade, so as to afford a direct force into the anchor shank during embedding of the anchor into the ground.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of an earth anchor of a unique style, having an integral blade that connects with a shaft portion of its driving shank, while the power tool driving the anchor into the ground matingly connects upon the anchor shank that extends downwardly for piercing into the earth ahead of its cutting blade. In addition, the blade of this particular earth anchor is of a unique design, being formed polygonal in shape, multi-sided in configuration, and generally having four lineal sides that connect together through arcuate corners to form the specifically styled blade of this invention. The arcuate corners of the blade are generally formed having a radius approximating one-half the width of the blade, so that linear surfaces forming the sides of the shaped blade are intervened by rounded corners having dimensions substantially equivalent in length to that of each linear side.

But, one of the enhanced results through the usage and application of this particular invention is that due to the unique configuration of the blade, with its cutting edge arranged at the lower most flight of the formed helical blade, and intervened by an arcuate edge between the blade and its adjacent W side, since, in this particular design, the outermost edge of the cutting blade integrally blends through arcuately with a linear part of one of its sides, the combination of said blade, arcuate edge, and the flattened surface of the adjacent side, cooperate to form a multitude of directional forces that function to enhance the earth penetrating ability of the blade, and at the same time, do so at a reduced moment of force than that which is normally required for driving the standard circularly formed helical blade into the earth. That flattened side and arcuate edge for the blade adjacent to the outer edge of the beveled or leading cutting edge of the blade becomes what may be identified as also a working edge for the helix, so that not only are cutting forces generated along the leading edge of the blade, but driving forces likewise are exerted perpendicularly from the adjacent arcuate and side edges of the blade that extends just away from and rearwardly of the leading edge for the said blade.

Usually the point loads and their reaction forces occur at a normal to the leading cutting edge segment of any helical blade, but where a lateral segment of the helix that is formed adjacent and extends rearwardly of the leading edge of the blade is integrally formed into the blade, it also generates a working force usually at a normal to its particular cutting edge configuration, and which forms a working moment of force that is in summation with the normal force exerted along the leading cutting edge of the blade. In this manner, the overall force deriving capacity of the blade during its installation and driving into the ground is substantially enhanced. In fact, through experimentation it has been determined that a helix formed in accordance with the teachings of this invention, as shown in the drawings, achieves an approximate 35% reduction in force requirements to achieve its embedment into the ground than is required. From the standard circular formed helix that is normally used in the trade, and as generally shown in the variety of prior art patents revealed in the background of this invention.

As is known, a moment of force results, and is determinable, by multiplying a force exerted at any given point by its perpendicular distance from the central axis of the object through which the driving force is transmitted. And, in this current invention, it can be readily determined that the general moment of forces are exerted by the leading or cutting edge of the blade, along its length, multiplied by those distances from the central axis of the shank portion of the blade. This is a standard method for determining the moment of force for any style of helical blade type earth anchor. But, with the additional moment of force being exerted through the blade design of this invention, that is through the arcuate and side flattened portions extending rearwardly from the outer leading and cutting edge of the blade such configuration also produces forces that extend at a perpendicular from these additional edges, and produce a moment of force that is determinable about the central axis of its shank. That is an additive type of force, which increases the moment of force generated during application and usage of this particular anchor, and which consequently reduces the overall force necessary to achieve a driving of this earth anchor into the ground.

While the helical blade for the earth anchor of this invention is generally disclosed in the preferred embodiment of this invention as being arranged at the bottom or ground inserting portion for the anchor, it is just as likely that the helical blade of this invention can be arranged in multiple components, spacedly along the shank portion for the tool, perhaps in increments of one or more feet apart, so as to provide for multiple anchoring of a multi-helix screw anchor into the ground. This construction for an anchor is generally disclosed in the U.S. Pat. No. 4,290,245, and owned by a common assignee of this invention.

DESCRIPTION OF THE PREFERRED EMBODIMENT

Figure 1:
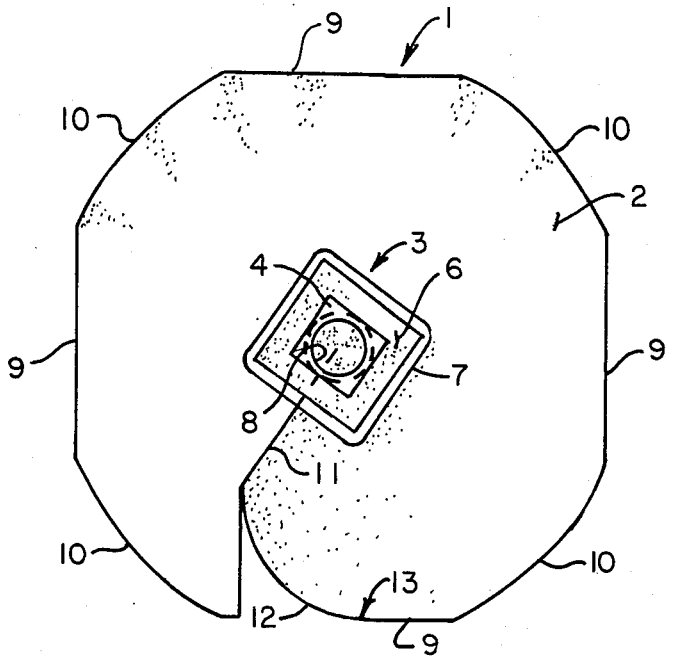
FIG. 1 is a plan view of the earth anchor with mulitiple-sided blade of this invention.
Figure 2:
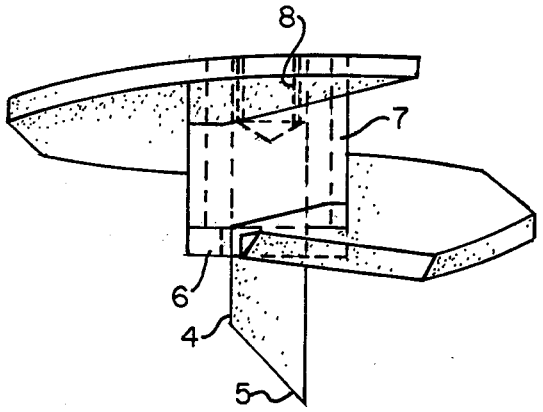
FIG. 2 is a front view thereof.
Figure 3:
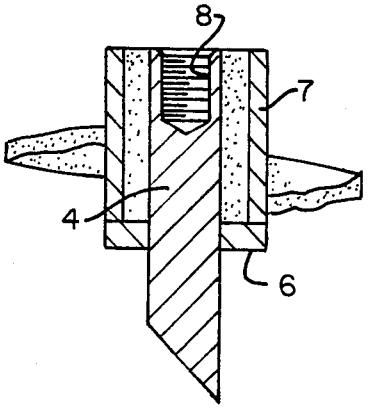
FIG. 3 is a partial transverse sectional view taken along the line 3—3 of FIG. 1.

In referring to the drawings, and more specifically FIG. 1, the earth anchor 1 of this invention is disclosed incorporating a blade 2 that is secured about its shank portion 3, with the shank being formed, as can be more specifically seen in FIG. 2, comprising a central portion 4 having a lower edge, as at 5, generally pointed or reasonably sharpened, in configuration, so as to conveniently pierce the soil as the anchor is initially applied into the ground. The shank portion also incorporates a cap means 6 integrally formed or secured with the central portion 4, and connecting with the cap means 6 is a sleeve 7 that extends upwardly, concentrically with the central portion 4 of the disclosed shank 3. As can be seen, the upper end of the central portion 4 has a counterbore, as at 8, provided therein, and which may be threaded, so that the tie rod or drive rod of the anchor installing tool may be conveniently connected therewith, so as to facilitate the hold of the drive shaft (not shown) about the shape of the central portion 4, as it drives the earth anchor deeply into the ground, through the exertion of mechanical force. As can also be seen in FIG. 1, both the outer sleeve 7, and the upper part of the central portion 4 of the shank are rectangular in configuration, or to some related shape, so that the drive member of the mechanical power driving means may conveniently slide and fit upon this central portion 4, although it does not necessarily, or not preferably, contact the inner surface of the sleeve 7.

More specifically, the blade 2 of this anchor is of a polygonal design, formed of a series of flattened surfaces, as at 9, intervened at their corners by means of the disclosed arcuate shapes, as at 10, and which enhances the earth penetrating ability of the blade for this anchor, and at reduced force, for reasons that have been previously summarized.

The lower flight of the helix for the blade 2 terminates at a cutting edge, as at 11, and which may be either beveled, or of a flat configuration, but yet which functions as a leading edge for driving the earth anchor into the ground as mechanical power or force is generated upon its drive shaft during its embedment. The leading edge 11 of this blade may lag somewhat rearwardly, in a manner as previously explained for benefits to be derived as disclosed in the U.S. Pat. No. 4,290,245, or it may extend perpendicularly from its integral sleeve 7, as shown. But, more significantly, the outer edge, as at 12, for the blade is arcuately formed and joins with the outer flattened or lineal surface, as at 13, for that lineal side 9 of the shaped blade. And, as previously explained, the combination of the force generated at the leading edge 11 of the said blade, in cooperation with the force that is generated along that segments 12 and 13 of the side 9 for the shaped blade, cooperate to generate additive forces that are in excess of those which can be attained by the leading edge 11 alone, and which results in a moment of force that is significantly increased over the spiral type of helix that is normally employed heretofore in the formation of such a blade, so that a lesser quantity of force is required to drive the multi-sided blade of the earth anchor of this invention deeply into the soil.

As previously explained, the design of the blade for the earth anchor of this invention functions at an efficiency due to the fact that the total moment of force required for driving of this anchor is reduced approximately 30 to 35% over the current and standard spiral wound helical type of anchor that is customarily employed in the trade. As further previously explained, that total moment relates to the installation force or torque required for anchor installation and is derived by multiplying this force times the distance of forces encountered on the helix leading edge, in addition to those segments of the edges 12 and 13 formed integrally and extending laterally and just rearwardly at the outer periphery of the cutting edge 11 for the blade 2 of this earth anchor.

Once again, while the helical blade of this particular invention has been defined and is shown as a single blade attached the sleeve component for this invention, it is just as likely that multiple blades of a multi-helix type can be applied upon a continuous sleeve or connecting shank portions for the anchor, so as to provide for multiple retention of the tool within the ground through the usage of a series of said helical blades upon such a sleeve or shank of the type that is driven into the ground during installation of this particular anchor means.

Variations or modifications to the structure of the earth anchor of this invention may occur to those skilled in the art upon reviewing the subject matter of this invention. Such variations or modifications, if within the spirit of this invention, are intended to be encompassed within the scope of any claims to patent protection issuing upon this invention. The description of the preferred embodiment set forth herein is done so for illustrative purposes only.

Having thus described the invention, what is claimed and desired to be secured by Letters Patent is:

1. An earth anchor for use with a drill tool for embedment within the ground and for resisting pulling or compressing forces tending to urge the anchor from its implanted position, comprising, said earth anchor having a shank portion, a continuous helical blade extending approximately a full flight and affixed to said shank portion and designed for cutting into the ground upon anchor application, said blade being of a substantially flattened multi-sided configuration, and having corners provided between adjacent sides, said corners being arcuate in configuration and blending into the adjacent sides, said blade having a pair of linear cutting edges proximate the lowermost section of its flight, each linear cutting edge having a length of less than one-half the radius at the arcuate corners of the said blade, and an arcuate cutting edge integrally formed between the pair of linear cutting edges, the combined length of said linear and arcuate cutting edges being substantially greater than the radius of the helical blade affixed to said shank portion, and said series of cutting edges extending for substantially less than one-fourth of the dimension of the flight of the continuous blade.

2. The invention of claim 1 and wherein each arcuate corner having a radius of approximately one-half of the width of the total blade.

3. The invention of claim 1 and wherein said shank portion including a lower edged central portion for piercing the ground, said portion extending upwardly centrally of the formed blade, a sleeve integrally connecting with the said central portion and extending upwardly surrounding and spacedly from the same, said blade connecting integrally with the exterior of the shank sleeve, and the upper part of the central portion provided for operatively mating with any drive tool for embedding said anchor into the ground.

4. The invention of claim 1 and including a series of continuous helical blades being fixed to said shank portion, said blades being spacedly arranged upon said shank portion and capable of being driven into the ground upon application of the said earth anchor.

5. The invention of claim 1 and wherein that linear cutting edge of the pair of cutting edges closest to the bottom of the blade flight being beveled for facilitating its cutting into the ground upon anchor application.

6. The invention of claim 5 and wherein the lowest liner cutting edge at the beginning of the blade flight, its arcuate cutting edge, and the next adjacent liner cutting edge of the pair of said cutting edges combining to reduce the torque requirements by as much as thirty-five percent during cutting by the blade of the anchor into the ground.

* * * * *

UNITED STATES PATENT AND TRADEMARK OFFICE

CERTIFICATE OF CORRECTION

PATENT NO. : 4,742,656

DATED : May 10, 1988.

INVENTOR(S) : Marion R. Farmer

It is certified that error appears in the above—identified patent and that said Letters Patent is hereby corrected as shown below:

Claim 6, line 41, change "liner" to ---linear---.

Claim 6, line 42, change "liner" to ---linear---.

Signed and Sealed this

Twentieth Day of September, 1988

*Attest:*

DONALD J. QUIGG

*Attesting Officer*

*Commissioner of Patents and Trademarks*